US006803895B2

(12) United States Patent
Knapp et al.

(10) Patent No.: US 6,803,895 B2
(45) Date of Patent: Oct. 12, 2004

(54) ACTIVE MATRIX DISPLAY DEVICE

(75) Inventors: Alan G. Knapp, Crawley (GB); Jason R. Hector, Redhill (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 309 days.

(21) Appl. No.: 10/153,251

(22) Filed: May 22, 2002

(65) Prior Publication Data

US 2002/0190939 A1 Dec. 19, 2002

(30) Foreign Application Priority Data

Jun. 6, 2001 (GB) ..... 0113736

(51) Int. Cl.[7] ..... G09G 3/36
(52) U.S. Cl. ..... 345/89; 345/100
(58) Field of Search ..... 345/100, 98, 94, 345/89, 92

(56) References Cited

U.S. PATENT DOCUMENTS 5,130,829 A 7/1992 Shannon ..... 359/59
5,764,210 A * 6/1998 Moon ..... 345/90
5,818,402 A * 10/1998 Park et al. ..... 345/58
6,172,663 B1 * 1/2001 Okada et al. ..... 345/96
6,222,516 B1 * 4/2001 Oda et al. ..... 345/94
6,677,925 B1 * 1/2004 Kawaguchi et al. ..... 345/98

FOREIGN PATENT DOCUMENTS

EP 0474231 A2 3/1992 ..... G09G/3/36

* cited by examiner

*Primary Examiner*—Xiao Wu
*Assistant Examiner*—Kevin M. Nguyen

(57) ABSTRACT

A method of driving an active matrix liquid crystal display in a partial display mode is provided, together with a display operable in accordance therewith. A live portion (4) of the display is driven to display image data (6) and a dormant portion (8) is driven to display a substantially constant grey scale level output. The method comprises applying a signal (40) to each of the column address conductors (18) associated with the dormant portion (8) which comprises a combination of a signal substantially the same as the signal (14) applied to the counter electrode and kickback correction, such that the resultant kickback correction applied to each of the picture elements associated with the dormant portion (8) substantially corresponds to the grey scale level of the dormant portion. This serves to reduce the power consumption of the dormant portion (8), whilst avoiding the application of a substantial DC across the picture elements of the dormant portion (8).

8 Claims, 2 Drawing Sheets

ACTIVE MATRIX DISPLAY DEVICE

The present invention relates to active matrix display devices, and more particularly to an active matrix liquid crystal display device (AMLCD) which is operable in a partial display mode and a method of driving the device.

AMLCDs utilising thin film transistors as switching devices for the picture elements are well known. An example is described in U.S. Pat. No. 5,130,829, the contents of which are hereby incorporated herein as reference material.

In many instances, it is desirable to minimise the power consumption of a display. This is particularly important in mobile devices such as mobile telephones or portable computers where reduced power usage extends the lifetime of the device's battery. One way to operate a display in a low power mode is to only drive a "live" portion of the display area to show data, with the remainder of the display blank. An example of this approach is described in EP-A-0474231 wherein image data is compressed and displayed in a reduced display area using fewer of the row and column driver circuits of the display device.

It is an aim of the present invention to provide a method of addressing an active display in a partial display mode in an improved manner relative to known techniques, and a display device for implementing the method.

The present invention provides a method of driving an active matrix liquid crystal display in a partial display mode in which a live portion of the display is driven to display image data and a dormant portion is driven to display a substantially constant grey scale level output, the display comprising a set of row address conductors and a set of column address conductors, an array of picture elements each defined by a respective electrode connected to a respective address conductor of both sets and an opposing counter electrode, a column driver circuit for applying signals to the set of column address conductors, and a counter electrode driver circuit for applying a signal to the counter electrode which includes kickback correction corresponding to a predetermined grey scale level, wherein the method comprises applying a signal to each of the column address conductors associated with the dormant portion which comprises a combination of a signal substantially the same as the counter electrode signal and kickback correction, such that the resultant kickback correction applied to each of the picture elements associated with the dormant portion substantially corresponds to the grey scale level of the dormant portion.

This technique enables the or each dormant portion of the display to be driven to display a substantially constant output without generating a substantial DC across the picture elements of the dormant portion. Whilst a partial display mode can be achieved by turning off the drive to the column address conductors of the blank portion of the display which is not being used to display image content, this approach is problematic as the picture elements associated with those column address conductors will settle to a DC voltage. This DC across the picture elements may reduce the lifetime of the display and/or may result in image artefacts when a full display mode is restored.

According to a preferred embodiment of the method, the signal applied to each column address conductor associated with the dormant portion comprises a combination of the counter electrode signal and kickback correction substantially corresponding to the grey scale level of the dormant portion. The power consumption of the dormant portion can thereby be reduced. The column address conductors may be driven efficiently by using the same signal as is applied to the counter electrode.

To reduce the voltage swing applied to the column address conductors, and therefore the voltages which the column driver circuit needs to be able to handle, a counter electrode modulation drive scheme may be employed.

The invention further provides an active matrix liquid crystal display device operable in a partial display mode in which a live portion of the display is driven to display image data and a dormant portion is driven to display a substantially constant grey scale level output, the device comprising a set of row address conductors and a set of column address conductors, an array of picture elements each defined by a respective electrode connected to a respective address conductor of both sets and an opposing counter electrode, a counter electrode driver circuit for applying a signal to the counter electrode which includes kickback correction corresponding to a predetermined grey scale level, a column driver circuit for applying signals to the set of column address conductors, the signal applied to column address conductors associated with the dormant portion comprising a signal substantially the same as the counter electrode signal, and means for adding kickback correction to the signal applied to the column address conductors associated with the dormant portion, such that the resultant kickback correction applied to each of the picture elements associated with the dormant portion substantially corresponds to the grey scale level of the dormant portion.

Preferably, the adding means is operable to combine the counter electrode signal with a kickback correction signal substantially corresponding to the grey scale level of the dormant portion. The display device may include switching means for connecting column address conductors associated with the dormant portion to the output of the adding means.

An embodiment of the invention will now be described by way of example and with reference to the accompanying schematic drawings, wherein.

Figure 1A:
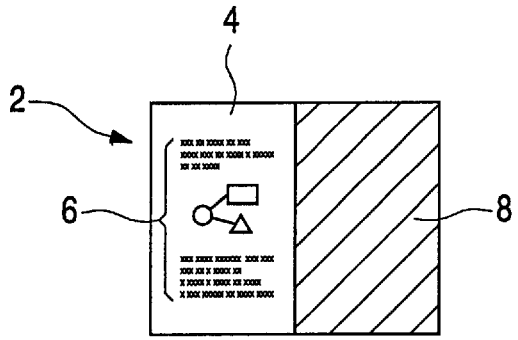
FIGS. 1A and 1B show examples of display images during partial display modes.

It should be noted that the figures are diagrammatic and not drawn to scale. Relative dimensions and proportions of parts of these figures have been shown exaggerated or reduced in size, for the sake of clarity and convenience in the drawings.

Figure 1B:
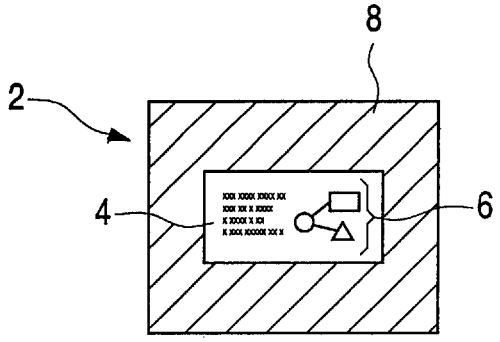

FIGS. 1A and 1B illustrate examples of display images during partial, low power display modes which are achievable using a method and an AMLCD device embodying the present invention. In each case, the display screen 2 is divided into two regions: a live portion 4 which shows image data 6 and a dormant portion 8, which is driven to display a substantially constant output. In FIG. 1A, the display screen is divided into the two portions 4 and 8 between two adjacent vertical column address conductors (not shown), whilst in FIG. 1B the live portion 4 is positioned centrally and surrounded by the dormant portion 8. As will be appreciated from the following description, the screen could be divided into any configuration of two or more portions, each of which either shows image data or lies dormant.

Figure 2:
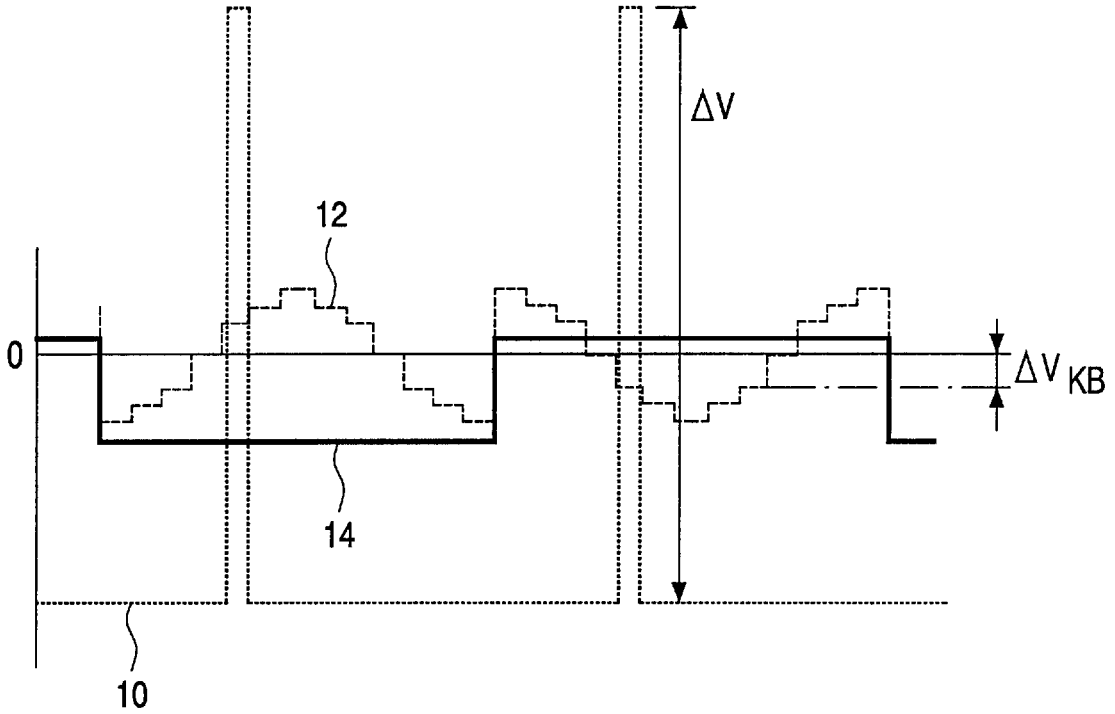
FIG. 2 shows typical driving waveforms for a display using counter electrode modulation.

FIG. 2 shows, by way of illustration, typical voltage waveforms for driving a display to show image data using counter electrode modulation. The frame inversion drive scheme shown is well known in the art and is therefore not described here. A row address conductor waveform 10, a column address conductor waveform 12, and the counter electrode waveform 14 are shown for a selected picture element. The counter electrode waveform 14 is offset from 0V by an amount $\Delta V_{KB}$ to provide correction for kickback.

Figure 3:
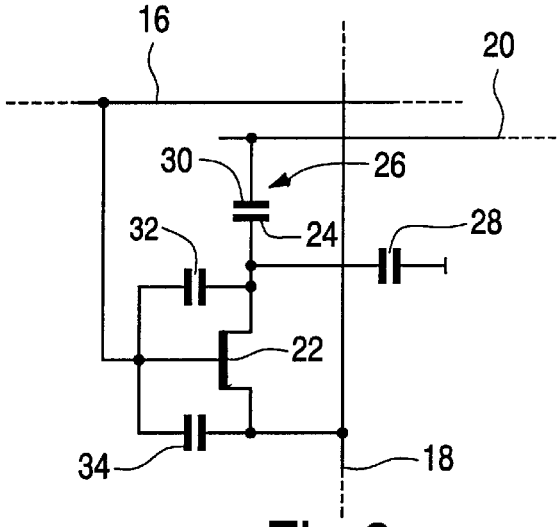
FIG. 3 shows a circuit diagram of a display picture element.

The amount of kickback correction required for a given picture element depends on the voltage across the liquid crystal pixel thereof during the previous frame. Normally, the kickback correction level applied to the counter electrode is selected for an average, mid-grey scale level for the display. FIG. 3 shows a circuit diagram for a typical liquid crystal picture element, comprising a row address conductor 16, a column address conductor 18, and a counter electrode conductor 20. The gate terminal of a thin film transistor (TFT) 22 is connected to the row address conductor, its source terminal is connected to the column address conductor, and its drain terminal is connected to a pixel electrode 24, on one side of the LC pixel 26, and one side of a storage capacitor 28. The other side of the storage capacitor is connected to a separate capacitor electrode (not shown). On the other side of the LC pixel is the counter electrode 30. The parasitic gate-drain and gate-source capacitances 32, 34 inherent in the TFT are also shown.

The amount of kickback correction required on a given pixel is governed by the following equation:

$$\Delta V_{KB(GL)} = \Delta V \times \frac{C_{GD}}{C_{GD} + C_{LC(GL)} + C_{STORE}(+C_{OTHER})}$$

where $\Delta V_{KB(GL)}$ is the amount of kickback correction corresponding to a grey level, GL, $\Delta V$ is the change in the row voltage when the row is turned off (see FIG. 2), $C_{GD}$ is the total parasitic gate-drain capacitance of the TFT between the row address conductor and the pixel electrode, $C_{LC(GL)}$ is the capacitance of the LC pixel at grey level GL, and $C_{STORE}$ is the capacitance of the storage capacitance. $C_{OTHER}$ refers to any other parasitic capacitances that appear in parallel with the pixel. The value of $C_{LC(GL)}$ varies substantially with the voltage across the pixel, which leads to substantial variation in the amount of kickback correction needed at different grey levels. For example, typical values for $C_{GD}$ and $C_{STORE}$ are 16 and 250 fF, respectively, whilst the value of $C_{LC(GL)}$ may vary between 100 and 300 fF, as the pixel grey scale varies from white to black.

In a partial display mode, it will generally be desirable for the dormant portion of the display to be driven to a uniform grey scale level. However, if this level is not substantially the same as the mid-grey scale level selected for the display, the inventors have realised that the kickback correction applied for the mid-grey level will be inappropriate for the dormant portion and result in application of DC to the pixels thereof.

Figure 4:
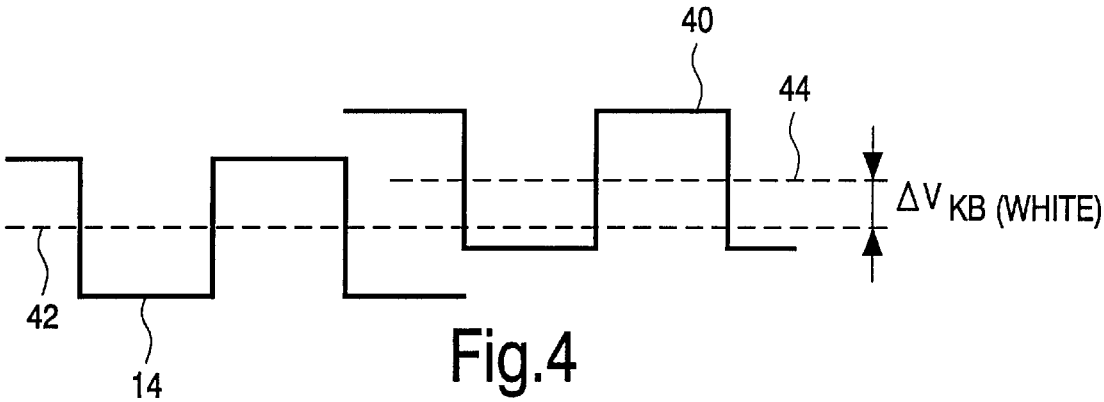
FIG. 4 shows counter electrode and column address conductor waveforms generated in accordance with the method of the invention.

An implementation of a solution to this problem will now be described with reference to FIGS. 4 and 5, for an embodiment where the display is being driven in counter electrode modulation mode. In that case, the power consumption can be reduced by driving the column address conductors with the same AC signal as is applied to the counter electrode and to the low voltage level of the rows. To a first approximation, this will drive the pixels in the dormant portion of the display at 0V peak to peak, resulting in a white grey scale level in a normally white display (and black in a normally black display). However, as the TFTs in this area of the display are still being addressed by the normal row drive signal, normal kickback effects will occur, so that simply connecting the columns to the same voltage as the counter electrode will result in a DC voltage on the pixels equal to the kickback voltage for a white pixel, $\Delta V_{KB(WHITE)}$. Depending on the display design, this could be up to 1V.

In order to minimise any image retention effects as a result of this DC voltage, the DC level of the should be offset from the mean counter electrode voltage by an amount $+\Delta V_{KB(WHITE)}$. This is illustrated in FIG. 4. Dotted line 42 represents the mean of the counter electrode voltage waveform 14. Waveform 40 represents the voltage applied to the column address conductors associated with the picture elements of the dormant portion of the display. Its mean voltage level 44 is offset from that of the counter electrode by $+\Delta V_{KB(WHITE)}$. The waveform 40 therefore consists of a signal which has the same AC component as the counter electrode waveform 14, but is offset by $+\Delta V_{KB(WHITE)}$.

Figure 5:
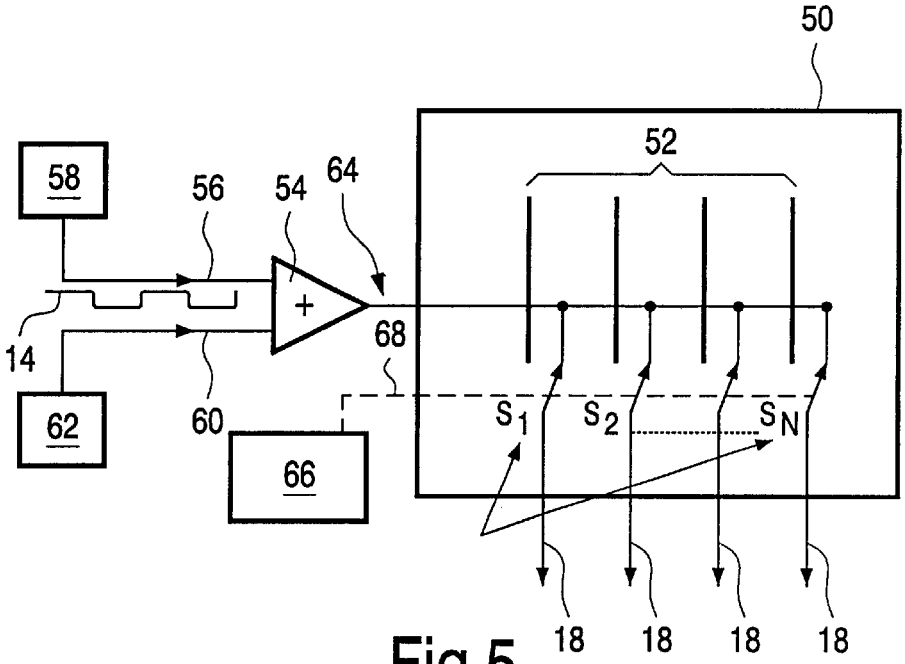
FIG. 5 shows circuitry for driving column address conductors according to an embodiment of the invention.

An embodiment of drive circuitry for implementing the above approach is illustrated in FIG. 5. The column drive circuit 50 is operable to generate drive signals representing image data for column address conductors 18 which are fed along output lines 52. An adding means in the form of a summing amplifier 54 is provided to generate a signal at its output 64 for application to the column address conductors of picture elements in a dormant portion of the display. One of its inputs 56 is connected to the counter electrode driver circuit 58 to receive the counter electrode waveform 14. The other amplifier input 60 is connected to a kickback correction signal generator 62 which outputs a DC signal corresponding to the desired level of kickback correction, for example, $+\Delta V_{KB(WHITE)}$.

An array of additional switches $S_1$ to $S_N$ is included within the column driver circuit 50, one for each of the column address conductors 18 which are associated with a portion of the display which is switchable into a dormant mode. They are arranged to selectively connect each column address conductor to the respective output line 52 or to the output 64 of the amplifier 54, depending on whether the next picture element to be addressed by the conductor is in a live or dormant portion of the display. The switching of the switches is controlled by switching control means 66, which may form part of the column driver circuit, via line 68.

It will be appreciated that the amplifier 54 may be provided in the form of a discrete IC, or inside one of other driver ICs in the display. Alternatively, in the case of a display manufactured using polycrystalline silicon techniques in which an integrated column driver circuit may be provided on the substrate of the display (which would typically be formed of glass or a polymer material), the amplifier may be fabricated on the display substrate.

The amount of power dissipated in driving a dormant portion of the display depends on how accurately the column voltage matches the counter electrode and low row voltages. If these voltages slew at different rates then more charge flows in and out of the display, which consumes power. It is therefore advantageous to ensure that the switches $S_1$ to $S_N$ have a low enough impedance to allow the column voltage to follow the counter electrode voltage. It may be advantageous to limit the slew rate of all of these signals as this will make matching the slew rates easier and reduce power consumption.

Addition of the DC offset along line 60 serves to minimise any DC voltage on the pixels of a dormant portion of the display. This minimises image retention effects caused by any DC voltage which could result in a non-uniform image for a period after the dormant portion is switched to display image data.

From reading the present disclosure, other variations and modifications will be apparent to persons skilled in the art. Such variations and modifications may involve equivalent and other features which are already known in the design, manufacture and use of active matrix display devices, and component parts thereof, and which may be used instead of or in addition to features already described herein.

Although claims have been formulated in this Application to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. Features which are described in the context of separate embodiments may also be provided in combination in a single embodiment. Conversely, various features which are, for brevity, described in the context of a single embodiment, may also be provided separately or in any suitable subcombination. The Applicants hereby give notice that new claims may be formulated to such features and/or combinations of such features during the prosecution of the present Application or of any further Application derived therefrom.

What is claimed is:

1. A method of driving an active matrix liquid crystal display in a partial display mode in which a live portion of the display is driven to display image data and a dormant portion is driven to display a substantially constant grey scale level output, the display comprising a set of row address conductors and a set of column address conductors, an array of picture elements each defined by a respective electrode connected to a respective address conductor of both sets and an opposing counter electrode, a column driver circuit for applying signals to the set of column address conductors, and a counter electrode driver circuit for applying a signal to the counter electrode which includes kickback correction corresponding to a predetermined grey scale level, wherein the method comprises applying a signal to each of the column address conductors associated with the dormant portion which comprises a combination of a signal substantially the same as the counter electrode signal and kickback correction, such that the resultant kickback correction applied to each of the picture elements associated with the dormant portion substantially corresponds to the grey scale level of the dormant portion.

2. A method of claim 1 wherein the signal applied to each column address conductor associated with the dormant portion comprises a combination of the counter electrode signal and kickback correction substantially corresponding to the grey scale level of the dormant portion.

3. A method of claim 1 wherein a row or frame inversion drive scheme is employed.

4. A method of claim 1 wherein a counter electrode modulation drive scheme is employed.

5. A method of claim 1 wherein a column or pixel inversion drive scheme is employed.

6. An active matrix liquid crystal display device operable in a partial display mode in which a live portion of the display is driven to display image data and a dormant portion is driven to display a substantially constant grey scale level output, the device comprising a set of row address conductors and a set of column address conductors, an array of picture elements each defined by a respective electrode connected to a respective address conductor of both sets and an opposing counter electrode, a counter electrode driver circuit for applying a signal to the counter electrode which includes kickback correction corresponding to a predetermined grey scale level, a column driver circuit for applying signals to the set of column address conductors, the signal applied to column address conductors associated with the dormant portion comprising a signal substantially the same as the counter electrode signal, and means for adding kickback correction to the signal applied to the column address conductors associated with the dormant portion, such that the resultant kickback correction applied to each of the picture elements associated with the dormant portion substantially corresponds to the grey scale level of the dormant portion.

7. A device of claim 6 wherein the adding means is operable to combine the counter electrode signal with a kickback correction signal substantially corresponding to the grey scale level of the dormant portion.

8. A device of claim 6 including switching means for connecting column address conductors associated with the dormant portion to the output off the adding means.

* * * * *